US005574797A

United States Patent [19]

Geisenberger

[11] Patent Number: 5,574,797

[45] Date of Patent: Nov. 12, 1996

[54] SUSPENSION MOUNT FOR LOUDSPEAKERS

[75] Inventor: Stefan Geisenberger, Straubing, Germany

[73] Assignee: Nokia Technology GmbH, Pforzheim, Germany

[21] Appl. No.: 358,742

[22] Filed: Dec. 19, 1994

[30] Foreign Application Priority Data

Dec. 18, 1993 [DE] Germany ..... 43 43 324.3

[51] Int. Cl.[6] ..... H04R 25/00

[52] U.S. Cl. ..... 381/193; 381/202; 381/204

[58] Field of Search ..... 381/193, 202, 381/204; 181/171, 172, 173

[56] References Cited

U.S. PATENT DOCUMENTS

| | | | |
|---|---|---|---|
| 4,881,617 | 11/1989 | Farsone . | |
| 5,111,510 | 5/1992 | Mitobe | 381/193 |
| 5,115,474 | 5/1992 | Tsuchiva et al. . | |
| 5,123,053 | 6/1992 | House | 318/193 |
| 5,255,328 | 1/1993 | Akiniwa et al. | 381/193 |
| 5,319,718 | 6/1994 | House | 381/193 |

FOREIGN PATENT DOCUMENTS

| | | |
|---|---|---|
| 0552040 | 7/1993 | European Pat. Off. . |
| 3241757 | 5/1984 | Germany . |
| 3640264 | 6/1988 | Germany . |
| 801318 | 1/1981 | U.S.S.R. . |
| 1788599 | 1/1993 | U.S.S.R. . |
| 9003710 | 4/1990 | WIPO . |
| 9323966 | 11/1993 | WIPO . |

OTHER PUBLICATIONS

Patents Abstracts of Japan 59–27697(A); E–247, May 29, 1984 vol. 8/No. 115.

Patents Abstracts of Japan 62–141893(A); E–562, Dec. 5, 1987 vol. 11/No. 374.

Patents Abstracts of Japan 1–319396(A); E–901, Mar. 12, 1990. vol. 14/No. 130.

Patent Abstracts of Japan, vol. 6, No. 67 (E–104) Apr. 28, 1982 & JP–A–57 009 195 (Matsushita Electric Ind Co Ltd.).

Patent Abstracts of Japan, vol. 8, No. 268 (E–283) Dec. 7, 1984 & JP–A–59 139 791 (Matsushita Denki Sangyo KK).

*Primary Examiner*—Curtis Kuntz
*Assistant Examiner*—Vivian W. Chang
*Attorney, Agent, or Firm*—Ware, Fressola, Van Der Sluys & Adolphson

[57] ABSTRACT

In the state of the art, it is known to connect diaphragms (11) of cone loudspeakers to the loudspeaker frame (10) by means of so-called beads (13). Such beads (13) are predominantly made of plastic or rubber, and are connected to the diaphragm (11) or the loudspeaker frame (10) by means of suitable adhesives. This type of connection limits the free selection of the above named components, because not all elastic bead materials can be connected to the diaphragm (11) with the required mechanical stability. The selection of materials is further restricted when the loudspeaker is subjected to ambient temperatures above 100° C., because the adhesive connections lose their strength under such conditions. The invention has therefore the task of presenting a high-strength suspension mount for the diaphragms of cone loudspeakers. This task is fulfilled in that the bead (13) is made of an injection-moldable and high-temperature resistant elastomer material (e.g. silicon rubber or fluoroelastomer) and the inner edge (18) of the bead (13) is connected to the upper edge (19) of the diaphragm (11) by vulcanization. Special high-strength connections of diaphragm (11) and bead (13) are provided when the upper edge (19) of the diaphragm (11) has perforations (20), and the areas of the inner edge (18) on both sides of the diaphragm (11) are connected by beading material through the perforations (20) of the diaphragm (11).

8 Claims, 3 Drawing Sheets

SUSPENSION MOUNT FOR LOUDSPEAKERS

TECHNICAL FIELD

The invention concerns suspension mounting of cone loudspeakers, particularly the formation of high temperature resistant beads and their attachment to the diaphragm and the loudspeaker frame.

BACKGROUND OF THE INVENTION

Cone loudspeakers essentially consist of a conical diaphragm, a magnet system, a voice coil and a loudspeaker frame. The magnet system is connected to the loudspeaker frame. The diaphragm is connected to the voice coil and placed in the loudspeaker frame, where the voice coil dips into the air gap built into the magnet system. The upper edge of the diaphragm is connected to the loudspeaker frame. Special conditions are linked to this connection between the diaphragm and the loudspeaker frame. In particular, it is necessary for the connection between the diaphragm and the loudspeaker frame to provide uniform excursion resistance to the diaphragm along its entire excursion path. Today, arrangements called beads have proved to fulfill this requirement, which are attached to the upper edge of the diaphragm where they bridge the gap between the diaphragm and the loudspeaker frame, and are connected to the loudspeaker frame. Such beads, which are circular in shape, are either made of rubber or plastic, since only these materials have the necessary elastic properties. In most cases, the area where the bead bridges the gap between the upper edge of the diaphragm and the attachment area on the loudspeaker frame, is arched.

The connection between the upper edge of the diaphragm and the inner edge of the bead, and the connection between the outer edge of the bead and the loudspeaker frame, is a coupling agent. High-quality adhesives are required because of the high mechanical load on the latter connection, which must be carefully adapted to the materials being connected. However, the free selection of materials for beads and diaphragms is limited by the high mechanical load on the adhesive bond, because even carefully adapted adhesives are not able to permanently bond all the combinations of diaphragm, bead and frame materials being considered. The selection of materials is further limited if the loudspeaker operates in elevated ambient temperatures (such as above 100° C.). This is due to the fact that many materials already begin to soften in this temperature range. Problems with the mechanical strength of the bond connection can arise even with materials that are not critical in the cited temperature range, because many of such bonds lose their original strength above 100° C.

For that reason, the invention has the task of presenting a suspension mount for cone loudspeakers, which even resists temperatures above 100° C. to about 230° C.

SUMMARY OF THE INVENTION

This task is fulfilled by a suspension mount for cone loudspeakers with a diaphragm, with a loudspeaker frame, and with a bead, whose outer edge is connected to the loudspeaker frame and the inner edge is connected to the upper edge of the diaphragm, wherein the bead is made of an injection-mouldable and high-temperature resistant elastomer material and the inner edge of the bead is connected to the upper edge of the diaphragm by spraying the upper edge of the diaphragm with the beading material.

The fact that the bead itself is made of silicon rubber or of a fluoroelastomer material makes the bead high-temperature resistant, without loss of the required elastic properties. Therefore, a loudspeaker which is fitted with a bead of an elastomer is suitable to cancel sound waves existent in hot exhaust gas streams. In the case that the bead is not made of silicon rubber but of a fluoroelastomer material, the resistance in respect of temperature and of solvents is furthermore improved. Any problems relating to connecting the elastomer material bead are prevented by spraying the bead on the upper edge of the diaphragm.

If the diaphragm is made of metal, deformation of the diaphragm from the effect of the spraying force need not be feared. Furthermore, metal diaphragms have an advantage over conventional paper or plastic diaphragms, in that they have great stability and can also be used without any problems above the 100° C. temperature range.

A particularly stable connection between the inner edge of the bead and the upper edge of the diaphragm is provided if the upper edge of the diaphragm is perforated, because this ensures that after the upper edge of the diaphragm has been sprayed, the beading material areas on both sides of the diaphragm are interconnected by the beading material through the perforations.

The attachment of the outer edge of the bead to the loudspeaker frame is achieved by clamping the outer edge of the bead between the ring bearing surface of the loudspeaker frame and a peripheral ring, in order to obtain the necessary seal of the areas located in front of and behind the diaphragm. For example, the latter can be obtained very simply by placing screw and rivet connections through the ring bearing surface of the frame, the outer edge of the bead and the peripheral ring.

A particularly simple connection of the outer edge of the bead and the ring bearing surface of the loudspeaker frame is provided, if the outer edge of the bead has a peripheral ring with at least one of its circular ring surfaces sprayed with beading material, and the circular ring surface of the peripheral ring that is sprayed with beading material is pressed against the ring bearing surface of the loudspeaker frame. In that case, affixing the peripheral ring during the connection to the loudspeaker frame can be omitted. The necessary pressure on the outer edge of the bead can be obtained by corresponding screw and rivet connections, which pass through the peripheral ring, the outer edge of the bead and the ring bearing surface of the loudspeaker frame.

The sprayed connection between diaphragm and bead, or between peripheral ring and bead, is further improved if the sprayed areas of these components are coated with a coupling agent prior to vulcanizing the beading material.

BEST MODE FOR CARRYING OUT THE INVENTION

The invention will now be explained in more detail by means of the figures.

Figure 1:
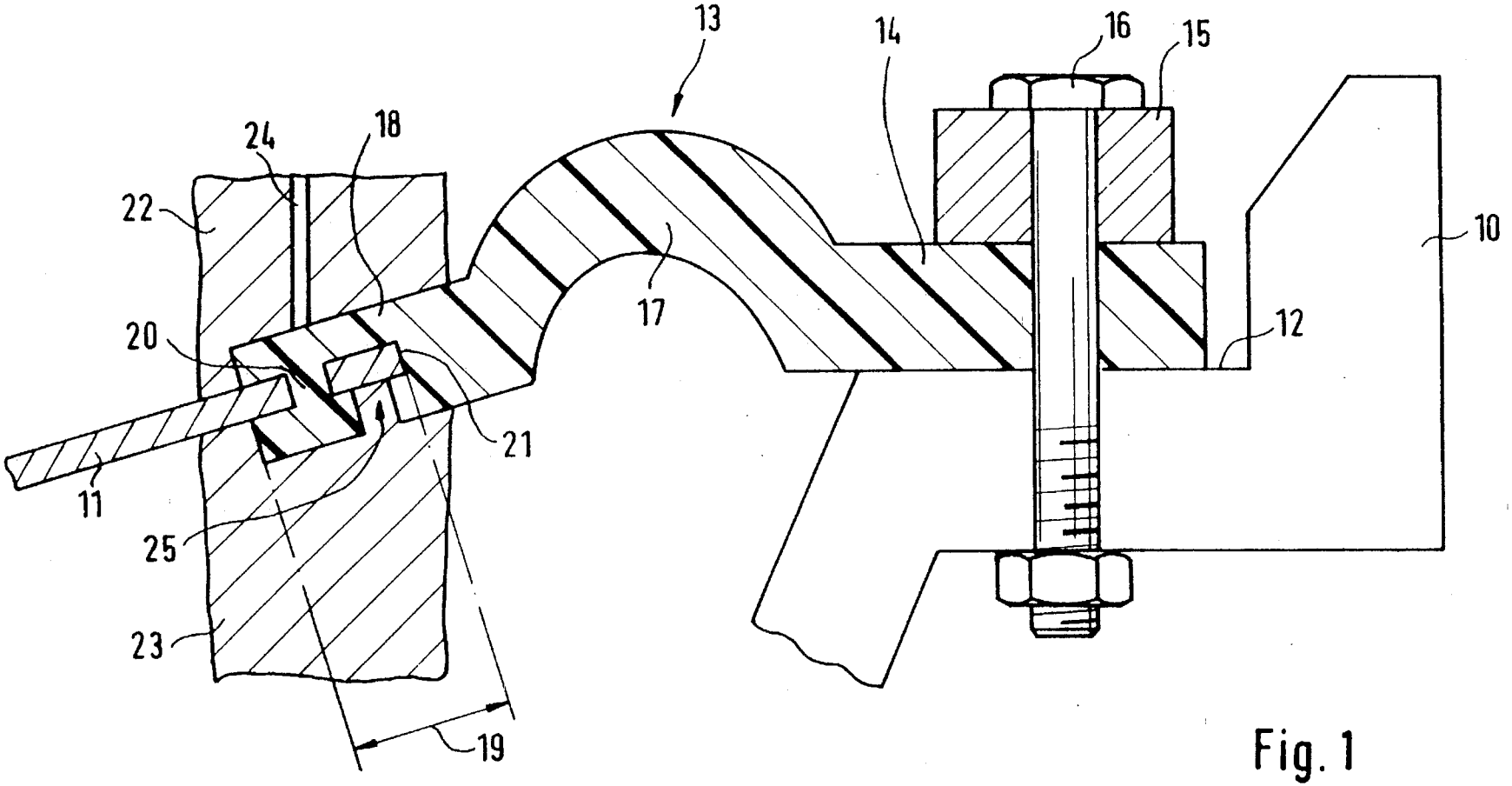
FIG. 1 shows a section through the suspension mount area of a cone loudspeaker.

FIG. 1 shows a section through the suspension mount area of a cone loudspeaker. The loudspeaker frame has reference number 10 and the diaphragm has reference number 11. The loudspeaker frame 10 is equipped with a ring bearing surface 12. The silicon material bead 13 extends between the loudspeaker frame 10 and the diaphragm 11. The silicon material is Silopren HV3 from the manufacturer BASF, which has a hardness of about 50 Shore A. To make the resistance—in comperision to silicon beads—more stable in respect of temperature and solvents, such a bead shall be made of a fluoroelastomer material. Fluoroelastomer materials are known under the trade mark "Viton" of the company Dupont and under the trade mark "Fluorel" of the company 3M.

The outer edge 14 of the bead 13 rests on the ring bearing surface 12. A peripheral ring 15 is placed on the side of the outer edge 14 of bead 13 that faces away from the ring bearing surface 12. In the present configuration example, this peripheral ring 15 is made of aluminum, and can be made of a different material in another configuration example not shown here. The outer edge 14 of the bead 13 is clamped between the peripheral ring 15 and the ring bearing surface 12, by placing a screw 16 through the ring 15, the outer edge 14 of bead 13 and the loudspeaker frame 10. Since the ring bearing surface 12 and the outer edge 14 of bead 13 are circular in shape, it is necessary to attach the outer edge 14 of bead 13 to the loudspeaker frame 10 with a number of screws 16, to achieve the necessary seal of areas located in front of and behind the diaphragm 11.

An arched area 17 is attached to the outer edge 14 of bead 13 in the direction of diaphragm 11, which blends into the inner and also ring-shaped form of the inside edge 18 of bead 13. This inner edge 18 of bead 13 covers the upper edge 19 of diaphragm 11 on both sides.

Figure 3:
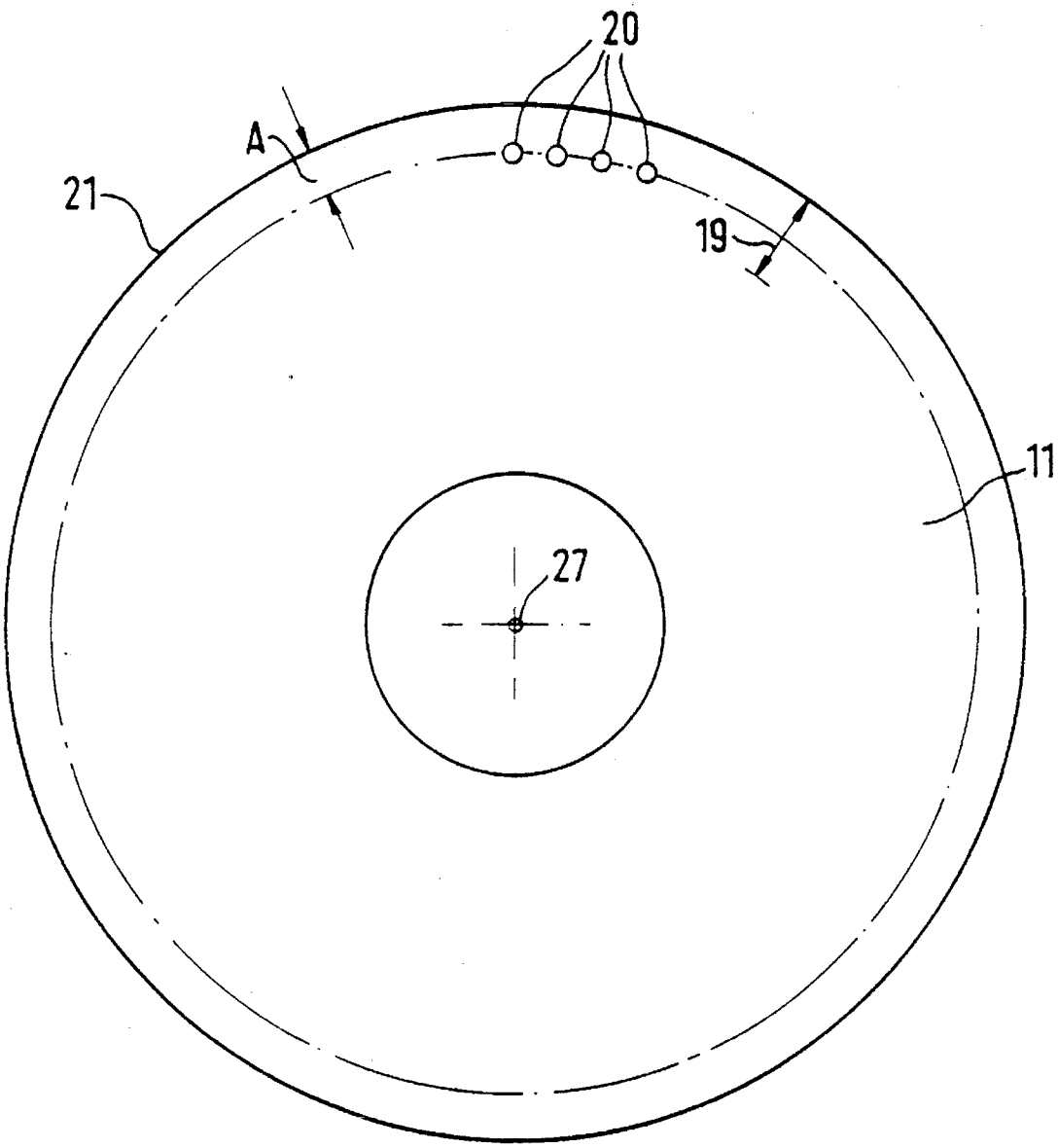
FIG. 3 shows a top view of a diaphragm.

As is made clear by FIG. 3 in this connection, the upper edge 19 of diaphragm 11 has a peripheral perforation. These openings 20, of which only 4 are illustrated in FIG. 3, form the perforations and are round in this configuration example, with a diameter of 1.5 mm and a distance A of about 3 mm from the peripheral edge 21 of diaphragm 11. The distance between the perforations is about 10 mm.

It can clearly be seen in FIG. 1 that the perforations 20 in diaphragm 11 are filled with beading material, so that the areas of the lower edge 18 of bead 13, located above and below the diaphragm 11, are connected with each other through the diaphragm 11. This arrangement provides high mechanical strength to the connection between diaphragm 11 and the bead 13. Another improvement of the mechanical strength of the connection between diaphragm 11 and bead 13 can be achieved by coating the interfaces of diaphragm 11, which are in contact with the beading material, with a coupling agent (not illustrated).

The diaphragm 11 illustrated in conjunction with FIGS. 1 and 3 is made of aluminum with a wall thickness of 0.2 mm. Although the best experience was gained with aluminum as the diaphragm material in the arrangement illustrated in FIG. 1, the invention is not limited to the use of aluminum as the diaphragm material. Rather, all materials are suitable, which do not undergo any deformation of the upper edge area 19, when the selected spray technique is used to vulcanize the bead 13.

To clarify the latter, FIG. 1 shows a section of the upper form 22 and the lower form 23 of the spraying tool in the transition area between diaphragm 11 and bead 13. Since the spray channels 24 are only located in the upper form 22, it cannot be excluded, in spite of the relatively low spraying pressure of up to 60 bar during vulcanization of the bead 13, so that the usually very stable aluminum diaphragm 11 is not deformed under the effect of the spraying pressure in the area where both forms 22, 23 protrude into the spraying space. For this reason, a shoulder 25 is made in the lower form 23, which supports the upper edge 19 of diaphragm 11 near its peripheral edge 21 inside the spraying tool.

Figure 2:
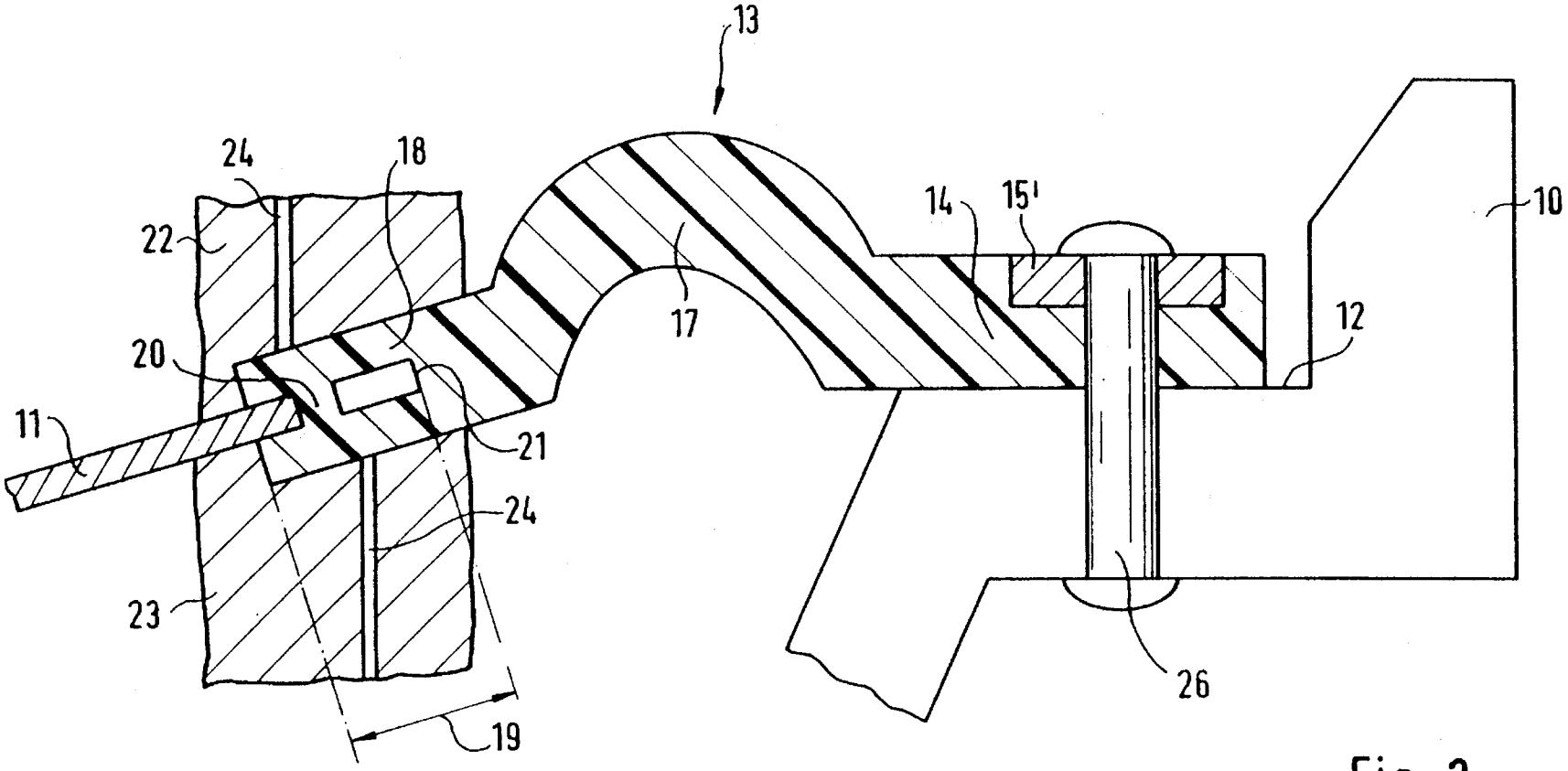
FIG. 2 is another depiction of FIG. 1.

The configuration shown in FIG. 2 only differs from the configuration in FIG. 1 by a change in the connection between the outer edge 14 of bead 13 and the loudspeaker frame 10, and by a modified form of the connection between the inner edge 18 of bead 13 and the diaphragm 11.

The peripheral ring 15' is integrated into the outer edge 14 of bead 13, namely in that the ring 15' is placed into the spraying tool (not illustrated) prior to vulcanizing the bead 13, so that it bonds to the bead 13 during the vulcanization. The joint between the outer edge 14 and ring 15' simplifies the connection of bead 13 to the loudspeaker frame 10, because the adjustment of the ring according to FIG. 1 is omitted.

In the configuration example of FIG. 2, the upper edge 14 of bead 13 is connected to the loudspeaker frame 10 with rivets 26, so that in the joined condition, the areas of the upper edge 19 of diaphragm 11, which are vulcanized to the lower circular ring surface of the peripheral ring 15', are pressed against the ring bearing surface 12 to establish the required seal.

The upper edge 19 of diaphragm 11 is also coated on both sides with beading material. In the configuration example shown here, the areas of the inner edge 18 of bead 13 on both sides of diaphragm 11 are also connected with each other through the perforations 20 in the diaphragm. However, differently than in FIG. 1, the lower form 23 in FIG. 2 does not have a shoulder 25. Still, damage to the end of the upper edge 19 of diaphragm 11 protruding into the form space should not be feared, since the lower form 23 also has spray channels. The latter ensures that uniform pressure conditions exist on both sides of diaphragm 11 during the vulcanization of bead 13, preventing damage to the upper edge 19 during the vulcanization of bead 13.

Finally, it should be pointed out that the ring 15 according to FIG. 2 is not necessarily smooth-walled. Rather, this ring 15 can also be equipped with openings and indentations, to improve the attachment of ring 15' to the outer edge 14 of bead 13 during the vulcanization.

Nor is it necessary for the perforations 20 in the diaphragm 11 to have the same distance from the rotational axis 27. Furthermore, neither is the perforation of the upper edge of the bead limited to round perforations 20.

I claim:

1. Suspension mount for cone loudspeakers with a diaphragm (11), with a loudspeaker frame (10), and with a bead (13), whose outer edge (14) is connected to the loudspeaker frame (10) and the inner edge (18) is connected to the upper edge (19) of the diaphragm (11), wherein the bead (13) is made of an injection-mouldable and high-temperature resistant elastomer material, and the inner edge (18) of the bead (13) is connected to the upper edge (19) of the diaphragm (11) by spraying the upper edge (19) of the diaphragm (11) with beading material, wherein the upper edge (19) of the diaphragm (11) has a circumferential perforation having a plurality of openings (20) which are filled after being sprayed with the beading material, so that the areas of beading material on both sides of the upper edge (19) of diaphragm (11) are connected with each other through the openings (20) of the diaphragm (11).

2. Suspension mount according to claim 1, wherein the diaphragm (11) is made of metal.

3. Suspension mount according to claim 1, wherein the outer edge (14) of the bead (13) is connected to the loudspeaker frame (10) in such a way, that the outer edge (14) of bead (13) is clamped between the ring bearing surface (12) of the loudspeaker frame (12) and a peripheral ring (15).

4. Suspension mount according to claim 1, wherein the outer edge (14) of the bead (13) has a peripheral ring (15'), where at least one of its circular ring surfaces is sprayed with beading material, and in the condition when bead (13) and loudspeaker frame (10) are joined, the circular ring surface of the peripheral ring (15'), which is sprayed with beading material, is pressed against the ring bearing surface (12) of the loudspeaker frame (10).

5. Suspension mount according to claim 4, wherein the areas of the diaphragm (11) or the peripheral ring (15, 15'), which are coated with the beading material, contain a coupling agent between the elastomer material and the diaphragm (11) or the peripheral ring (15').

6. Suspension mount according to claim 1, wherein the elastomer from which the bead is built is a silicon rubber.

7. Suspension mount according to claim 1, wherein the elastomer from which the bead is built is a fluoroelastomer.

8. Suspension mount according to claim 4, wherein the areas of the diaphragm (11) or the peripheral ring (15, 15'), which are coated with the beading material, contain a coupling agent between the elastomer material and the diaphragm (11) or the peripheral ring (15').

* * * * *

UNITED STATES PATENT AND TRADEMARK OFFICE

CERTIFICATE OF CORRECTION

PATENT NO. : 5,574,797

DATED : November 12, 1996

INVENTOR(S) : Stefan Geisenberger

It is certified that error appears in the above-indentified patent and that said Letters Patent is hereby corrected as shown below:

Item [56] References Cited:

Cover page of patent, line 19 reads "Farsone" should read --Faraone--

Cover page of patent, line 21 reads "Tsuchiva et al." should read --Tsuchiya et al.--

Cover page of patent, line 22 reads "318/193" should read --381/193--

Cover page of patent, line 23 reads "1/1993" should read --10/1993--

Cover page of patent, line 24 reads "House" should read --Yocum--

In Abstract, line 11, reads "100° C.," should read --100° C,--

Signed and Sealed this

Twenty-fifth Day of March, 1997

*Attest:*

Bruce Lehman

BRUCE LEHMAN

*Attesting Officer*

*Commissioner of Patents and Trademarks*